US009775196B2

(12) United States Patent
Song et al.

(10) Patent No.: US 9,775,196 B2
(45) Date of Patent: Sep. 26, 2017

(54) SELF-HEATING CONCRETE USING CARBON NANOFIBER PAPER

(75) Inventors: Gangbing Song, Pearland, TX (US); Christiana Chang, Houston, TX (US); Yi Lung Mo, Pearland, TX (US)

(73) Assignee: UNIVERSITY OF HOUSTON, Houston, TX (US)

( * ) Notice: Subject to any disclaimer, the term of this patent is extended or adjusted under 35 U.S.C. 154(b) by 1304 days.

(21) Appl. No.: 13/186,770

(22) Filed: Jul. 20, 2011

(65) Prior Publication Data

US 2012/0018415 A1 Jan. 26, 2012

Related U.S. Application Data

(60) Provisional application No. 61/365,852, filed on Jul. 20, 2010.

(51) Int. Cl.

| | |
|---|---|
| ***H05B 1/00*** | (2006.01) |
| ***H05B 3/00*** | (2006.01) |
| ***H05B 3/28*** | (2006.01) |

(52) U.S. Cl.

CPC ..... *H05B 3/0004* (2013.01); *H05B 3/283* (2013.01); *H05B 2214/02* (2013.01)

(58) Field of Classification Search

CPC ..... H05B 3/0004; H05B 3/283
USPC ..... 219/213, 541, 679, 646, 553, 770, 772, 219/780; 392/432, 435, 439
See application file for complete search history.

(56) References Cited

U.S. PATENT DOCUMENTS

| | | | | |
|---|---|---|---|---|
| 3,300,253 A | | 1/1967 | Hylak | |
| 4,089,142 A | | 5/1978 | Kachadorian | |
| 4,564,745 A | * | 1/1986 | Deschenes | F24D 13/024 219/213 |
| 4,878,332 A | * | 11/1989 | Drake | F24D 3/141 219/213 |
| 5,595,171 A | | 1/1997 | Makin | |
| 6,825,444 B1 | * | 11/2004 | Tuan et al. | 219/213 |
| 7,247,822 B2 | | 7/2007 | Johnston | |
| 2003/0155347 A1 | | 8/2003 | Oh et al. | |
| 2004/0245234 A1 | * | 12/2004 | Gehring | H05B 3/36 219/213 |

(Continued)

FOREIGN PATENT DOCUMENTS

| | | | | |
|---|---|---|---|---|
| JP | 2008042121 | * | 2/2008 | H01L 2924/00 |
| WO | WO 2010060388 | | 6/2010 | |

OTHER PUBLICATIONS

Zhao, Z., et al., "Processing and Structure of Carbon Nanofiber Paper," Journal of Nanomaterials, vol. 2009, Article ID 325769, 7 pages.

(Continued)

*Primary Examiner* — Phuong Nguyen
(74) *Attorney, Agent, or Firm* — Winstead PC

(57) ABSTRACT

Electric, self-heating concrete systems that uses embedded carbon macrofiber or nanofibers paper as electric resistance heating elements are disclose. The self-heating concrete systems may utilize the conductive properties of carbon macrofiber or nanofiber materials to heat a surface overlay of concrete with various admixtures to improve the concrete's thermal conductivity. The self-heating concrete systems allow concrete roadways or the like to be heated to above freezing temperatures in a freezing environment in a reasonable amount of time.

9 Claims, 6 Drawing Sheets

(56) References Cited

U.S. PATENT DOCUMENTS

| | | | | |
|---|---|---|---|---|
| 2006/0272796 | A1* | 12/2006 | Asmussen | H05B 3/36 165/53 |
| 2007/0186824 | A1 | 8/2007 | Takahashi et al. | |
| 2008/0138683 | A1* | 6/2008 | Yoshikawa | 429/30 |
| 2010/0129580 | A1* | 5/2010 | Sandaiji et al. | 428/36.91 |
| 2010/0175824 | A1 | 7/2010 | Hopkins et al. | |

OTHER PUBLICATIONS

Chung, D.D.L., "Self-heating structural materials," Institute of Physics Publishing, Smart Mater. Struct. 13 (2004) 562-565.

Kim, T., et al., "Carbon fiber mats as resistive heating elements," Letters to the Editor / Carbon 41 (2003) 2427-2451.

Yehia, S., et al., "Bridge Deck Deicing," 1998 Transportation Conference Proceedings, 51-57.

Yehia, S. "Bridge Deicing," Roads & Bridges, Oct. 2008, 32-35.

Yehia, S., et al., "No-Stick Surface / Conductive Concrete Used for Bridge Deck Deicing," Roads & Bridges, Apr. 2004, 26-28.

Zhao, H., et al., "Concrete Slab Installed with Carbon Fiber Heating Wire for Bridge Deck Deicing," Journal of Transportation Engineering, Jun. 2010, 500-509.

Chang et al. A feasibility study of self-heating concrete utilizing carbon nanofiber heating elements. Smart Materials and Structures v18 n12, Dec. 2009 [Dec. 14, 2011]. Retrieved from Internet: URL http://constructionz.com/cementflyash/a-feasibility-study-of-self-heating-concrete-utilizing-carbon-nanofiber-heating-elements.html/.

PCT International Search Report and Written Opinion for PCT/US2011/044655 dated Dec. 29, 2011.

* cited by examiner

SELF-HEATING CONCRETE USING CARBON NANOFIBER PAPER

RELATED APPLICATIONS

This application claims the benefit of U.S. Provisional Patent Application No. 61/365,852 to Song et al., filed on Jul. 20, 2010, which is incorporated herein by reference.

STATEMENT REGARDING FEDERALLY SPONSORED RESEARCH

This invention was made with government support under Grant Nos. CMMI-0620897 awarded by the National Science Foundation, P200A040058 awarded by the Department of Education, and FA8650-0S-D-5807 awarded by the US Air Force Research Laboratory. The government has certain rights in the invention.

FIELD OF THE INVENTION

This invention generally relates to design and construction of concrete systems. More particularly, the systems relate to an electric, self-heating concrete system that uses embedded carbon macrofiber or nanofibers paper as electric resistance heating elements.

BACKGROUND OF INVENTION

In freezing climates, snow and ice cause a number of dangerous roadway conditions that are both hazardous and inconvenient. Due to the dramatic increase of driving accidents caused by the slippery conditions of snow or sleet, improving road conditions in a timely and safe fashion is imperative. Though there have been a number of strategies developed to de-ice roadways, disadvantages of current methods range from being destructive to the road structure itself to being cost ineffective. Thus, there is a need for improved de-icing methods and systems.

The concrete heating systems and methods discussed herein provide an electric, self-heating concrete system that uses embedded carbon macrofiber or nanofibers paper as electric resistance heating elements. Various implementations discussed herein utilize the conductive properties of carbon macrofiber or nanofiber materials to heat a surface overlay of concrete with various admixtures to improve the concrete's thermal conductivity. In some embodiments, the self-heating concrete surface utilizes novel carbon macrofiber/nanofiber paper or carbon nanofiber/fiber enhanced concrete as resistive heating elements.

SUMMARY OF THE INVENTION

Illustrative implementations discussed herein provide a structurally integrated self-heating concrete system(s) and method(s) using carbon heating element(s). The carbon heating element(s) may any suitable carbon heating element(s), such as carbon macrofiber, nanofiber paper, and/or a combination thereof. The heating systems and methods discussed herein may be compatible common construction techniques and materials, as well as emerging engineering materials. Further, these systems and methods are cost comparable to roadway salting and other self-heating concrete systems.

The systems and methods overcome the above mentioned limitations by utilizing a chemically stable, non-corrosive heating element material which is compatible for use with cementitious materials. Utilizing a flexible, tensile material, such as continuous carbon fiber or carbon nanofiber, robustness of the heating system and integration into conventional construction methods is improved. These systems and methods provide novel electrically conductive concrete mixtures and casting techniques to structurally integrate carbon nanofiber paper heating elements. Thus, these systems and methods can eliminate the need for an external heating apparatus. These systems and methods can also provide a robust alternative to other cast-in heating methods.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
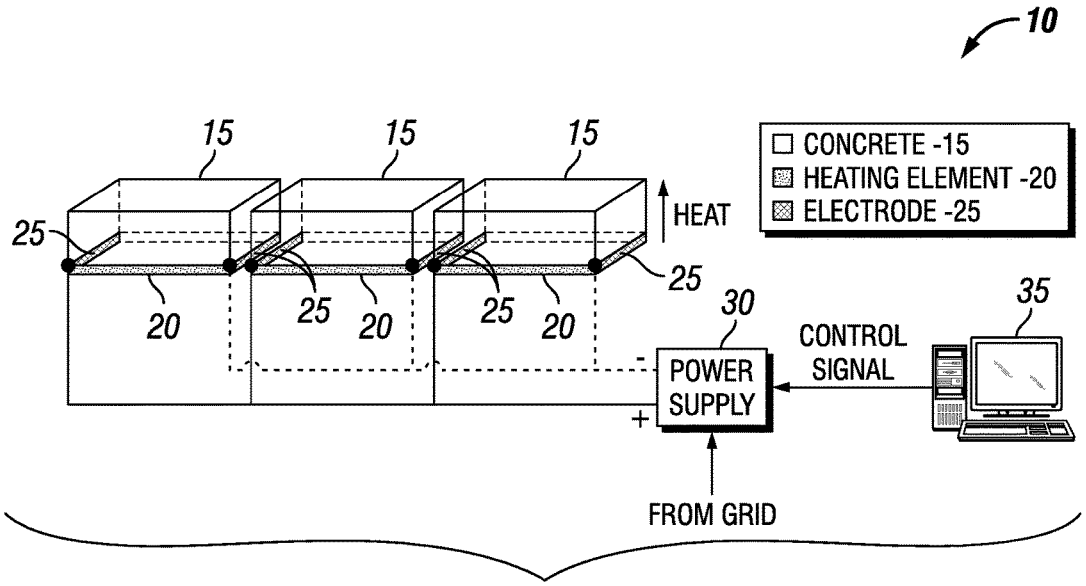
FIG. 1 is a schematic of an illustrative implementation of a self-heating concrete system.

Refer now to the drawings wherein depicted elements are not necessarily shown to scale and wherein like or similar elements are designated by the same reference numeral through the several views.

Referring to the drawings in general, it will be understood that the illustrations are for the purpose of describing particular embodiments of the disclosure and are not intended to be limiting thereto. While most of the terms used herein will be recognizable to those of ordinary skill in the art, it should be understood that when not explicitly defined, terms should be interpreted as adopting a meaning presently accepted by those of ordinary skill in the art.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention. The Detailed Description, taken with the drawings and/or examples make apparent to those skilled in the art how the several forms of the invention may be embodied in practice.

The following definitions and explanations are meant and intended to be controlling in any future construction unless clearly and unambiguously modified in the Description or Examples below or when application of the meaning renders any construction meaningless or essentially meaningless. In cases where the construction of the term would render it meaningless or essentially meaningless, the definition should be taken from Webster's Dictionary, 3rd Edition.

The most commonly used method for deicing roads involves the use of salts. Though salting roads is a cheap and effective method of deicing roads, corrosion of the reinforcing steel rebar in the concrete and environmental pollution have become major concerns regarding the use of salts. There is a strong relationship between saline pollution in groundwater and springs in urban areas, specifically due to the use of deicing salts. Elevated concentrations of salt in groundwater and on roadsides damages vegetation, decreasing aeration and availability of water in soil. The effects of salt on the corrosion of steel reinforcement are well known and extensive studies on the costs and extent of damage due to roadway salting have been conducted. In the US, the degradation of bridge decks was particularly pronounced in areas with freezing weather, most notably in the north east and along the Atlantic coast, where approximately 75% of bridges were still in sound condition after 20 years, as compared to 80% in the Great Lakes and 88% in the lower plains. It has been estimated that the costs of repairing bridge decks to be declared unsound from 1990-2000 are somewhere between $50-$200 million dollars a year.

A method for deicing roads that does not use salts is based on self-heating polymer-matrix composites in the concrete before the snow falls on the ground in order to convert it to water to avoid the accumulation of snow and/or the formation of ice. This method utilizes a porous mat comprising short carbon fibers and a small proportion of an organic binder as the interlayer. The fibers in a mat are randomly oriented in two dimensions. These mats are made by wet-forming, as in papermaking. These uncoated fiber mats are able to achieve a maximum self-heated temperature of 134° C., second only to flexible graphite (which is not suitable as a structural material), at a lower power consumption. The combination of low power and fast response time makes carbon fiber material is ideal for use as self-heating elements in concrete. However there are limitations to this method.

Though non-woven carbon fiber mats were previously experimentally used as heating elements, the proposed concept was only investigated as a surface mounted heating element and was not used as an embedded interlayer in a mortar or concrete sample. Specimens were simply tested for heating capacity and no design measures were taken for use of the carbon fiber mat as heating elements in specific applications or materials.

Another option for deicing roads makes use of carbon black mortar slabs (CBMS) to form self-heating concrete flooring material. Prior art show that the CBMS is able to heat a small room 10° C. uniformly above the "cold state" temperature in 330 minutes. Additionally, since the CBMS blocks themselves absorbed and retained about 36% of the generated heat, the CBMS floor heating system provided stable, lasting temperatures that were controllable. Continuous testing over 72 hours show that the physical properties of the CBMS blocks are stable over extended heating periods. Unfortunately, the CBMS system was only tested using mortar and not concrete, leaving the heating performance of carbon black infused concrete unknown. Also, both the carbon fiber and carbon black infused conductive concrete require high voltages to obtain the needed heating capacity, making them dangerous for operation on pedestrian or automotive throughways.

Another method uses the steel shavings and fibers in electrically conductive concrete for bridge deck deicing and snow melting. This method involves an optimized mix proportion of 20% steel shavings per volume and 1.5% steel fiber per volume of concrete, which is found to be effective in resistively heating the bulk concrete model bridge deck for deicing functions. Both ice melting and ice prevention processes are tested and found to be effective. Preliminary cost analysis showed that the proposed conductive concrete bridge deck is less expensive than conventional concrete deicing methods, such as plowing, when considering operation and installation costs. Additionally, the prior art also addresses the advantages of AC over DC power sources, physical property testing and workability evaluation of various mix proportions. The effects of various parameters on the melting time, power requirements, and performance of the conductive concrete revealed that there is a rational thermal conductivity value for the concrete due to the limits of Joule heating from the concrete's internal electrical resistance. Additionally, power requirements are identified for a number of operating scenarios, such as simple deicing, icing prevention, and deicing with wind. Furthermore, it has been concluded that under proper environmental and economic conditions, the omission of a thermal insulation layer between the conductive concrete and the old bridge deck may be more beneficial than its inclusion.

However, the use of steel fiber as the main electrically conductive element in the concrete makes the system vulnerable to the effects of moisture accelerated corrosion. It has yet to be seen whether the proposed steel fiber systems are robust over the operating life of the concrete or whether corrosion of the steel fibers results in degraded electrical performance over time.

The present invention relates to the design and construction of an electric, self-heating concrete system that uses embedded carbon macrofiber or nanofibers paper as electric resistance heating elements. More specifically, this invention utilizes the conductive properties of carbon macrofiber or nanofiber materials to heat a surface overlay of concrete with various admixtures to improve the concrete's thermal conductivity. The self-heating concrete surface utilizes novel carbon macrofiber/nanofiber paper or carbon nanofiber/fiber enhanced concrete as resistive heating elements.

The present invention involves the development of a structurally integrated, self-heating concrete system that uses electrically resistive heating elements to heat concrete roadways and melt surface ice or snow. In various embodiments, the current invention can include, without limitation: (1) the development of more thermally efficient concrete mixes; and (2) the development of a structurally integrated resistive heating element.

Self-Heating Concrete with Carbon Fiber Heating Element

One preferred embodiment of the present invention includes a flexible carbon heating element connected to an electrical grid to provide resistive heating capacity to the heating element which are embedded in the concrete. A thermally conductive concrete mix is poured over the carbon heating element using standard techniques. Other than possible small adjustments to the concrete mixing procedure and the layering of the carbon heating element, there are no other special techniques or process adjustments needed to lay the roadway.

FIG. 1 is a schematic of an illustrative implementation of a self-heating concrete system 10. Concrete mix, which may be a thermally conductive mix, is poured to form concrete slab(s) 15. Concrete slab(s) 15 are formed over heating element(s) 20. Heating element(s) 20 may be a carbon heating element, such as carbon macrofiber/nanofiber paper or carbon nanofiber/fiber enhanced concrete. Electrodes 25 are provided on heating element(s) 20 to apply a voltage for resistive heating. Electrodes 25 are coupled to a power supply 30. Power supply 30 provides the power necessary for resistive heating, and may also provide AC to DC power conversion if necessary. Power supply 30 is linked to a control module 35, such as a computer or the like, that provides a control signal for operating the system. Power supply 30 and control module 35 may be linked wirelessly, by wire, or any other suitable means. Control module 35 may control when power is provided to heating element 20 based on a detected temperature.

Figure 2:
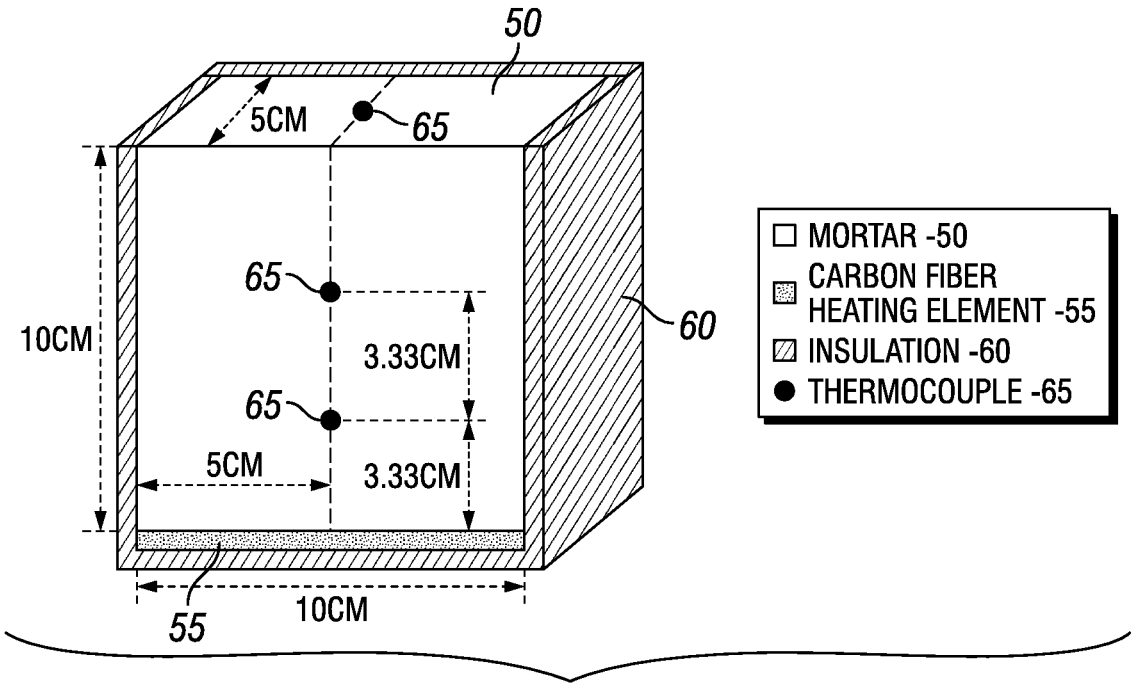
FIG. 2 is an illustrative implementation of a mortar sample.

FIG. 2 is an illustrative implementation of a mortar sample. Mortar 50 is formed on top of a carbon fiber heating element 55 in a square container 60. In the implementations shown, mortar 50 is formed into a 10 cm cube. Square container 60 is an insulating material. For the purpose of illustration, the front of square container 60 is omitted. Within mortar 50 several thermocouples 65 may be provided. Thermocouples 65 are provided centrally at the surface, at 3.33 cm from the surface, and at 6.66 cm from the surface of mortar 50. For example, type K thermocouples are positioned so that the junction tips are centered in the sample at the vertical positions indicated. While thermocouples are shown at the specific depths illustrated in FIG. 2, it will be recognized by one of ordinary skill in the art that thermocouple(s) may be disposed at any suitable depth, on the surface of the concrete, or a combination thereof. Further, one or more thermocouples may be utilized as desired. These thermocouples are used to record the temperature profile through the height and on the surface of the mortar block. Based on the temperatures detected by the thermocouples, a control module may control the operation of carbon fiber heating element 55. For example, a control module may switch carbon fiber heating element 55 off/on to maintain a desired surface temperature for the concrete; switch carbon fiber heating element 55 off when the surface temperature of the concrete is above a desired temperature; or a combination thereof. While 10 cm is a common specification for concrete road overlays, the systems and methods discussed herein may be suitable for concrete of different depths.

Experimental Test

To compliment the de-icing function, electrical heating tests were performed in a freezing environment. The mortar samples were heated to steady state conditions under fixed voltage supplies to the heating elements. The samples transient temperature profile and surface heat flux are recorded using thermocouples and a surface mounted, thin-film heat flux sensor (Omega HFS-4). Heating testing of these mortar samples using the carbon nanofiber (CNF) paper heating elements showed that sufficient heating capacity is provided for de-icing applications. Measurements of mortar surface temperature ranged from 2-6° C. To examine the effects of admixture on the thermal performance of mortar, a number of different mortar compositions are tested. The mortar compositions are summarized in Table I below:

TABLE I

Mortar Sample Compositions

| Designation | Admixture | Water:Cement | Sand:Cement | Admixture:Cement |
|---|---|---|---|---|
| PM | N/A | 0.50 | 2.00 | N/A |
| CCF-2.0 | CCF | 0.50 | 1.00 | 0.020 |

TABLE I-continued

Mortar Sample Compositions

| Designation | Admixture | Water:Cement | Sand:Cement | Admixture:Cement |
|---|---|---|---|---|
| CCF-3.0 | CCF | 0.50 | 1.00 | 0.035 |
| FA-5.0 | Fly Ash | 0.50 | 2.00 | 0.050 |
| FA-10.0 | Fly Ash | 0.50 | 2.00 | 0.100 |
| FA-15.0 | Fly Ash | 0.50 | 2.00 | 0.150 |
| ST | Steel Shaving | 0.50 | 2.00 | 0.20 by volume |

Heating Performance of Concrete System

In an illustrative implementation of a particular experimental setup conducted, carbon nanofiber paper was utilized as a flexible heating elements for mortars. Carbon nanofiber paper was selected due to its flexibility, ease of use, and electrical conduction properties. The heating elements were 5 cm by 5 cm square sheets of material centered along the width of the mortar sample in an arrangement similar to the sample shown in FIG. 2.

For the heating elements, electrodes were drawn using electrically conductive paint on the two, opposite short edges of the heating element. In some implementations, other types of electrodes may be utilized, such as metal electrodes, metal electrodes with conductive grease, carbon fiber/graphite based electrodes, or any suitable type of electrodes. The heating elements were each backed by a sheet of insulation to promote heat transfer to the mortar sample.

Heating of the mortar samples using the carbon heating elements was conducted using a constant DC voltage applied across the painted electrodes of the heating elements. In some implementations, it may be desirable to keep voltage to minimize electrical hazards; eliminate the need for city, county, state, and/or federal permits or the like for operating at higher voltages; conform to commonly available voltages from existing power sources; and the like. For example, in some instances it may be desirable to keep the operating voltage below 24V. The electrical parameters of the heating tests for the carbon nanofibers paper elements are given in Table II below:

TABLE II

Heating Test Electrical Parameters

| | Voltage (V) | Current (A) | Power (W) |
|---|---|---|---|
| CNF | 20 | 0.32 | 6.4 |

Figure 3:
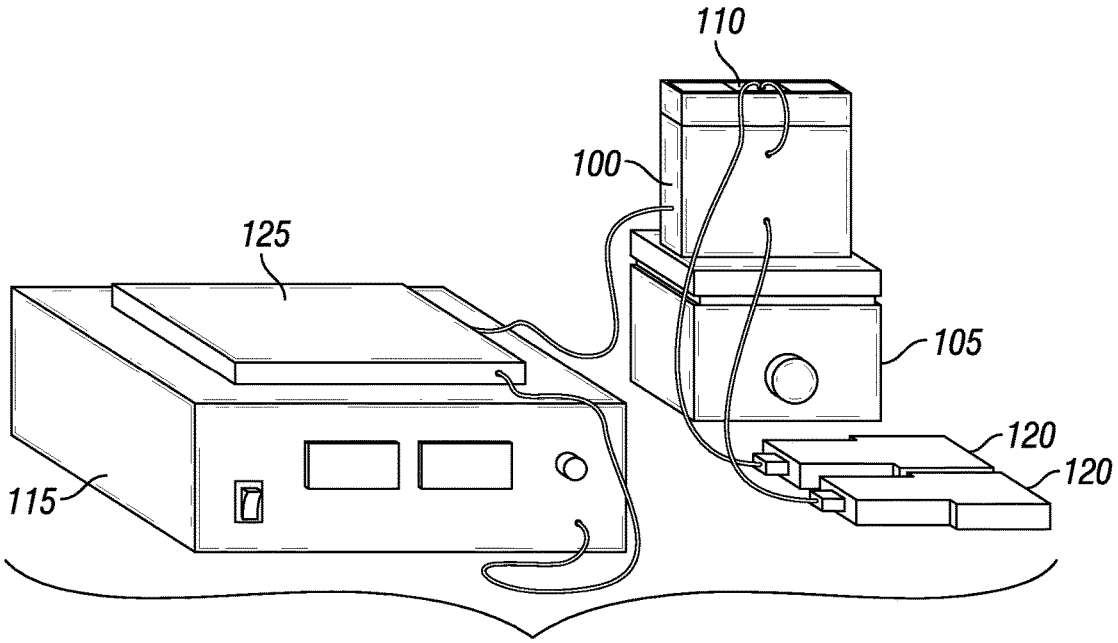
FIG. 3 is an illustrative implementation of a partial experimental set-up.
Figure 4:
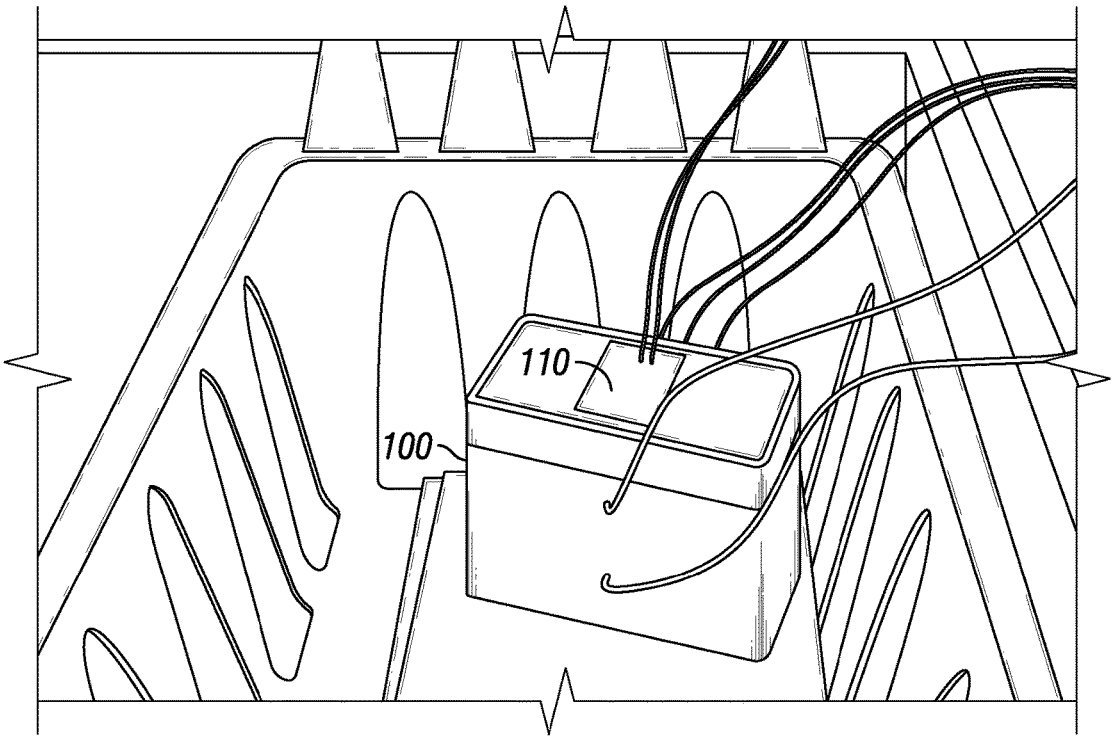
FIG. 4 is an illustrative implementation of a sample heating in freezer.

To test the intended application of the system, the mortar blocks and heating elements were placed in a freezing, temperature controlled environment at −12° C. as shown in FIG. 4. Temperature data for the embedded and surface thermocouple were recorded for four hours once the heating element was powered. FIG. 3 is an illustrative implementation of a partial experimental set-up. The testing of a mortar sample in a freezer as shown in FIG. 4.

Insulated mortar sample 100 was placed on hot plate 105. Note that within insulated mortar sample 100 a heating element (not shown) and thermocouples (not shown) are provided as shown in FIG. 2. Surface temperature sensor 110 is the only visible thermocouple. DC power supply 115 is utilized to power a carbon heating element. Surface temperature sensor 110 and the hidden thermocouples within mortar sample 100 are coupled to thermocouple readers 120. Thermocouple readers 120 were used to directly translate the thermocouple voltage to temperature for data recording. Further, amplification circuit 125 was needed for surface temperature sensor 110.

Figure 5A:
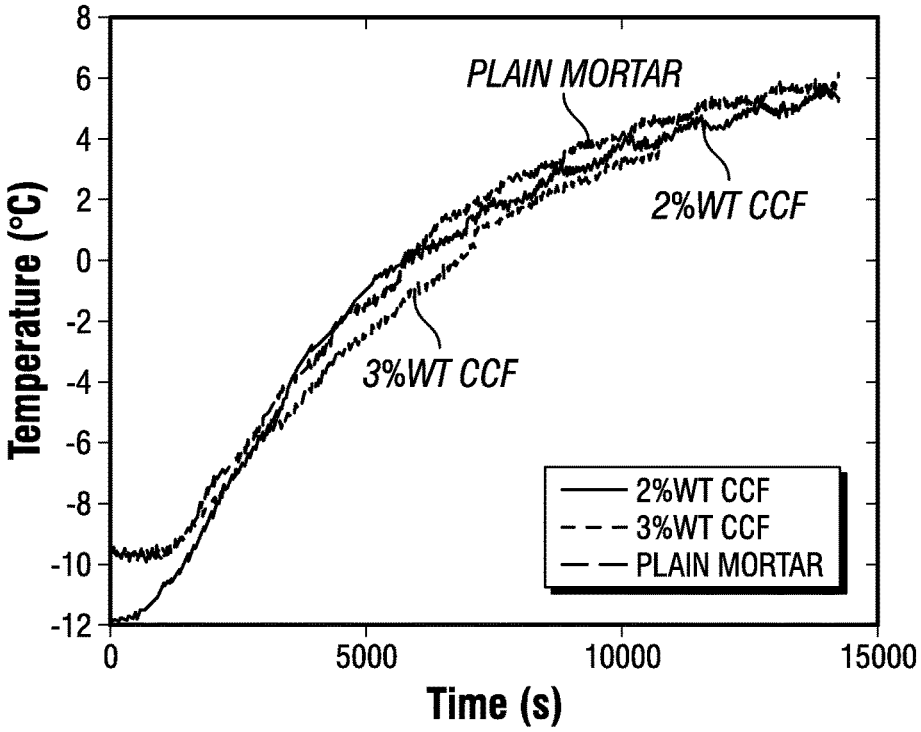
FIGS. 5*a* and 5*b* illustrate surface temperature time histories for CCF (chopped carbon fiber) samples and fly ash samples.
Figure 5B:
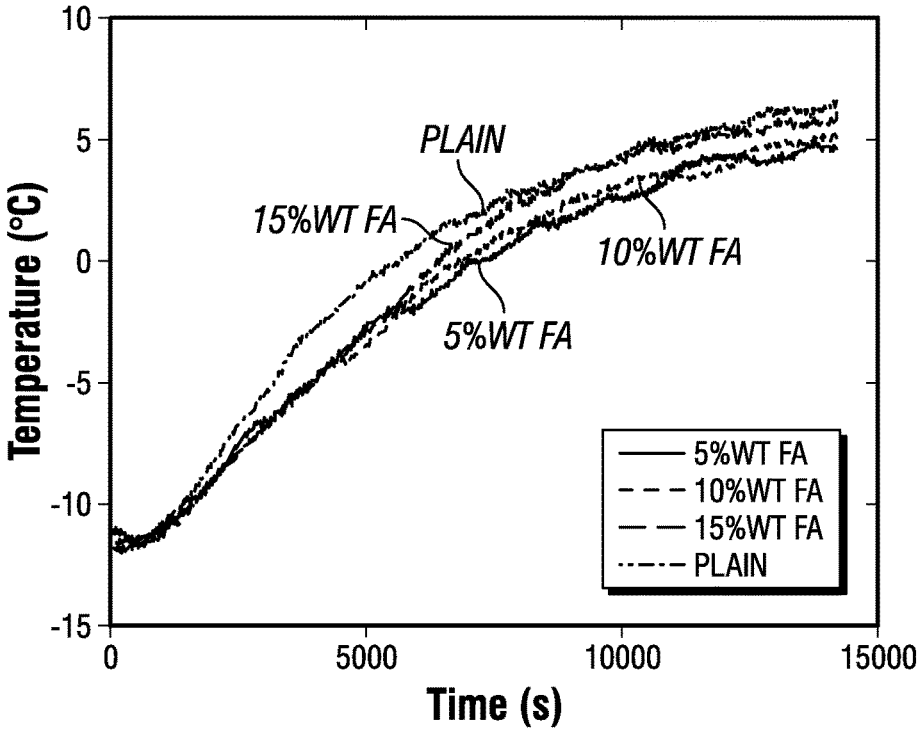
Figure 6:
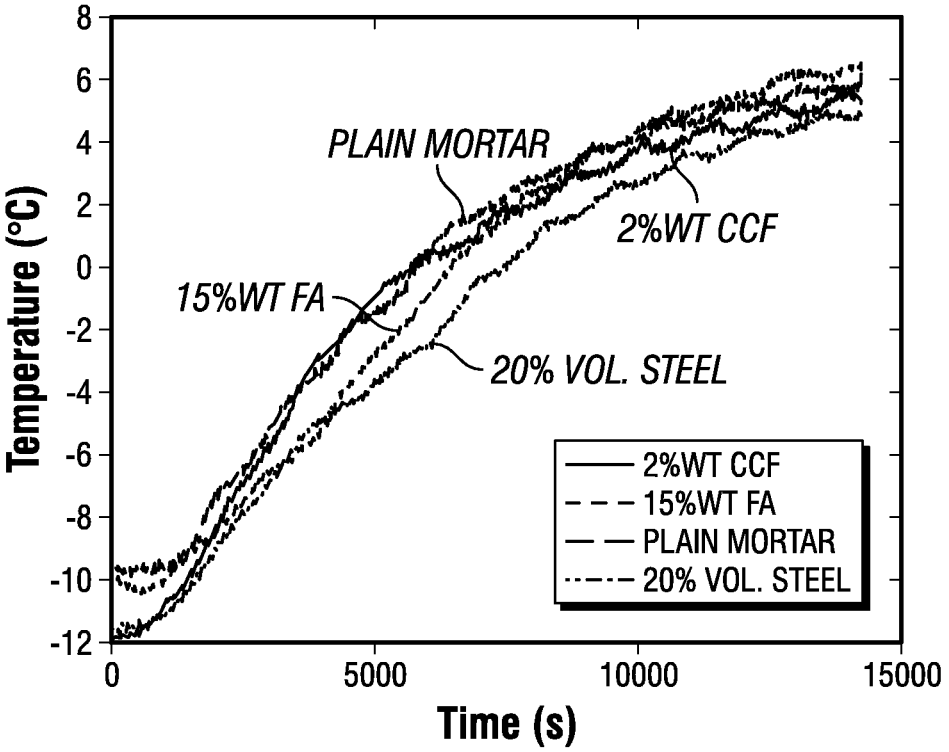
FIG. 6 is a comparison of admixture surface temperature performance.

A break-down of the performance (conducted at 6 W of power) amongst the CCF (Chopped Carbon Nano Fiber) based mortar and the FA (Fly Ash) based mortar are shown in FIGS. 5*a* and 5*b*. A summary comparison across the different types of admixture is given in FIG. 6. Results from FIG. 6 show that the samples effectively raise the surface temperature above freezing levels between 5,500 to 7,000 seconds at a 6W electric heating rate. However, the effects of admixtures were minimal and often decreased the final surface temperature reached, with only the 15% weight of cement fly ash sample out performing the plain mortar sample in terms of final surface temperature. Though the 2% weight of cement CCF had a marginally lower final surface temperature (−0.61° C. difference), the heating performance curve of (cement CCF) is similar to the plain mortar, reaching above freezing temperatures at roughly the same time (approximately 90 minutes into the test). Thus, though small additions of CCF do not contribute significantly to the thermal properties of the mortar, at the same time small additions of CCF are not detrimental to thermal performance and may be added if improvements to ductility or strength are required.

Analysis of the heating performance over time clearly shows that the CNF (Carbon Nano Fiber) paper heating elements are effective in heating the samples for possible applications in surface de-icing. At voltages safe for human operation, the obtained power output provided enough heating capacity to bring the surface temperatures of a mortar overlay above the freezing temperature of water at standard atmospheric conditions. FIG. 6 clearly shows that the CNF paper was able to heat all sample surfaces above 0° C., achieving an average surface temperature around 5° C. It should be noted that the plain, CCF admixture, and FA admixture samples were able to achieve above freezing temperatures within two hours of the start of heating, indicating that the heat output from the CNF paper is sufficient to heat 10 cm slabs of concrete in a reasonable amount of time to resume traffic quickly. Furthermore, the experimental set-up test used only enough CNF paper to cover half of the bottom surface of the sample. To further increase the available heating capacity, more CNF paper can be used to directly transfer heat to a larger surface area of the concrete slab.

In summary, the use of carbon nanofiber paper as resistive heating elements for mortar with various admixtures is feasible, especially for surface de-icing applications. For instance, in various experiments discussed above, CNF paper was used successfully to heat 10 cm thick mortar samples in a freezing environment such that the surface temperatures reached temperatures above the freezing point of water using a reasonable power input of 6W. Furthermore, the sample surfaces were able to heat from −10° C. to 0° C. in less than two hours for most samples, indicating that the achieved power input would allow a road surface to begin the de-icing procedure and return to service in a reasonable amount of time. By eliminating the need for manual labor to salt or shovel snow and ice off of the road surface, the proposed CNF paper heating system could reduce road maintenance costs and help reduce steel rebar corrosion due to salt water run-off. The concrete heating system can also be extended to incorporating the CNF into the concrete casting procedure.

The heating system can be used in low temperature floor heating systems. It can also be used to retrofit existing structures such as but not limited to aircraft driveways, airport runways, highways and bridges. It can also be used to provide electromagnetic interference immunity of a structure as well as traffic monitoring and weighing in motion for transportation systems.

Implementations described herein are included to demonstrate particular aspects of the present disclosure. It should be appreciated by those of skill in the art that the implementations described herein merely represent exemplary implementation of the disclosure. Those of ordinary skill in the art should, in light of the present disclosure, appreciate that many changes can be made in the specific implementations described and still obtain a like or similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The implementations described hereinabove are meant to be illustrative only and should not be taken as limiting of the scope of the disclosure.

What is claimed is the following:

1. A system for heating concrete roadways, the system comprising:

an outdoor roadway overlay comprising a concrete slab;

a mat formed from a carbon fiber heating element, wherein the carbon fiber heating element is carbon nanofiber paper or carbon macrofiber paper, the carbon nanofiber paper or the carbon macrofiber paper is flexible and non-corrosive, and the mat is coupled to a bottom of the concrete slab;

electrodes coupled to the mat;

a power source coupled to the electrodes, wherein the power source applies a voltage to the mat to generate heat for maintaining a desired surface temperature of the concrete slab to de-ice the concrete roadway; and at least one thermocouple embedded at a desired depth in the concrete slab to monitor a temperature of profile of the concrete slab.

2. The system of claim 1, wherein at least one of the thermocouples disposed on a top surface of the concrete slab to monitor a temperature of profile of the concrete slab.

3. The system of claim 1, further comprising a control module coupled to power source, wherein the control module is operable to control the voltage provided to the mat to maintain the desired surface temperature of the concrete slab to de-ice the concrete roadway.

4. The system of claim 1, wherein the electrodes are formed using electrically conductive paint, metal, carbon fiber, or graphite.

5. The system of claim 1, wherein the power source applies 24V or less across the electrodes.

6. The system of claim 1, wherein the concrete slab contains an admixture, and the admixture is chopped carbon nano fiber (CCF), fly ash, or steel shavings.

7. The system of claim 1, further comprising an insulator backing the mat.

8. The system of claim 1, wherein concrete slab is 10 cm thick.

9. The system of claim 1, wherein the desired surface temperature is approximately 5° C.

* * * * *